US012768363B2

(12) United States Patent
Ripattila et al.

(10) Patent No.: US 12,768,363 B2
(45) Date of Patent: Oct. 20, 2026

(54) METHOD FOR CONTROLLING OF A PUMP UNIT AND A PUMP UNIT FOR PUMPING LIQUID OR SUSPENSION

(71) Applicant: Sulzer Management AG, Winterthur (CH)

(72) Inventors: Janne Ripattila, Kotka (FI); Kalle Tiitinen, Kotka (FI)

(73) Assignee: Sulzer Management AG, Winterthur (CH)

( * ) Notice: Subject to any disclaimer, the term of this patent is extended or adjusted under 35 U.S.C. 154(b) by 45 days.

(21) Appl. No.: 18/872,643

(22) PCT Filed: Jun. 15, 2023

(86) PCT No.: PCT/EP2023/066116
§ 371 (c)(1),
(2) Date: Dec. 6, 2024

(87) PCT Pub. No.: WO2023/247319
PCT Pub. Date: Dec. 28, 2023

(65) Prior Publication Data

US 2025/0354561 A1 Nov. 20, 2025

(30) Foreign Application Priority Data

Jun. 23, 2022 (EP) ..... 22180825

(51) Int. Cl.

| | |
|---|---|
| ***F04D 27/00*** | (2006.01) |
| ***F04D 1/00*** | (2006.01) |
| ***F04D 1/06*** | (2006.01) |
| ***F04D 7/04*** | (2006.01) |
| ***F04D 9/02*** | (2006.01) |

(Continued)

(52) U.S. Cl.
CPC ..... *F04D 27/00* (2013.01); *F04D 1/00* (2013.01); *F04D 1/06* (2013.01); *F04D 7/04* (2013.01); *F04D 7/045* (2013.01); *F04D 9/02* (2013.01); *F04D 13/06* (2013.01); *F04D 15/00* (2013.01); *F04D 15/0066* (2013.01);
(Continued)

(58) Field of Classification Search
CPC ..... F04D 27/00; F04D 7/045; F04D 15/0066; F04D 29/66; F04D 31/00; F04D 1/06
See application file for complete search history.

(56) References Cited

U.S. PATENT DOCUMENTS

| | | | |
|---|---|---|---|
| 3,004,494 | A | 10/1961 | Corbett |
| 3,981,628 | A | 9/1976 | Carter |

(Continued)

FOREIGN PATENT DOCUMENTS

| | | | |
|---|---|---|---|
| DE | 564826 | C | 11/1932 |
| EP | 4015825 | A1 | 6/2022 |

*Primary Examiner* — Andrew J Marien
(74) *Attorney, Agent, or Firm* — Spencer Fane, LLP

(57) ABSTRACT

A method for controlling a pump unit for pumping liquid or suspension includes controlling a pump unit based on a determination of a combination of an inducer and a centrifugal pump at least on parameters of a total volumetric flow rate and pressure difference over the pump unit, and controlling the pump unit based on a rheology of a fluid to be pumped so that necessary fluidization parameters of the fluid are predetermined to enable operation of the pump unit, and the rotation speed of the inducer rotor or an output power of the inducer rotor is controlled to a desired volumetric flow rate.

16 Claims, 8 Drawing Sheets

(51) Int. Cl.

| | |
|---|---|
| ***F04D 13/06*** | (2006.01) |
| ***F04D 15/00*** | (2006.01) |
| ***F04D 29/22*** | (2006.01) |
| ***F04D 29/66*** | (2006.01) |
| ***F04D 31/00*** | (2006.01) |

(52) U.S. Cl.
CPC ..... *F04D 29/22* (2013.01); *F04D 29/2261* (2013.01); *F04D 29/66* (2013.01); *F04D 31/00* (2013.01)

(56) References Cited

U.S. PATENT DOCUMENTS

| | | | | | |
|---|---|---|---|---|---|
| 4,149,825 | A * | 4/1979 | Grennan | F04D 15/0011 | 415/11 |
| 4,449,888 | A * | 5/1984 | Balje | F04D 29/2277 | 415/62 |
| 4,770,604 | A * | 9/1988 | Luthi | F04D 29/2216 | 415/68 |
| 5,462,585 | A * | 10/1995 | Niskanen | D21C 7/08 | 162/57 |
| 5,951,262 | A * | 9/1999 | Hartman | F04D 1/06 | 417/423.5 |
| 10,422,337 | B2 * | 9/2019 | Daugaard | F04D 31/00 | |
| 2016/0305477 | A1 | 10/2016 | Dreiss et al. | | |
| 2022/0003241 | A1 * | 1/2022 | Mathew | F04D 7/06 | |
| 2024/0026884 | A1 * | 1/2024 | Titinen | F04D 31/00 | |

* cited by examiner

METHOD FOR CONTROLLING OF A PUMP UNIT AND A PUMP UNIT FOR PUMPING LIQUID OR SUSPENSION

CROSS-REFERENCE TO RELATED APPLICATIONS

This application is a U.S National Stage application of International Application No. PCT/EP2023/066116, filed on Jun. 15, 2023, which claims prior-ity to European Application No. 22180825.6, filed on Jun. 23, 2022.

BACKGROUND

Technical Field

The present disclosure relates to a method for controlling a pump unit. Especially the disclosure relates to a method for controlling a pump unit for pumping liquid or suspension, the pump unit comprises a centrifugal pump and an inducer in a proximity upstream of an inlet of the centrifugal pump:

- the centrifugal pump comprises a pump housing forming a flow channel inside the pump housing and an impeller configured to be rotated in the flow channel around a central axis by a shaft,
- the inducer comprises an inducer rotor having sleeve-shaped rotor body, the inducer rotor is configured to be rotated around the central axis in the flow channel, the rotor body is provided with a number of blades extending inwards from the rotor body.

The present disclosure relates also to a pump unit.

Background Information

Centrifugal pumps with conventional inducers are being used in pumping applications where there are challenging pumping conditions for example due to multiphase suspension consisting of fluid in gas, liquid and solid phases. These conventional inducers are mounted on a same axel as there is an impeller, thus rotating the same speed as the impeller.

A prior art publication CN111828391A provides a blade-adjustable shaft-less inducer for a pump. The inducer comprises a pump shell and an impeller, wherein the impeller is arranged in the pump shell, a plurality of inducer blades are evenly distributed on the extending section of an impeller cover plate of the impeller, a positioning device is arranged at the joint between each inducer blade and the impeller cover plate, external force enables the inducer blades to over-come positioning of the positioning devices and drives the inducer blades to rotate so as to adjust the angle of the inducer blades, and a thrust rotating device is arranged outside the pump shell and used for providing the external force. According to the inducer, by adjusting the placement angle of the blades, the pump can operate at the optimal working condition point under different working conditions; the inducer is suitable for the condition that inlet incoming flow is low-pressure; and the inducer adopts a hub-free form, and the blades are arranged at the lengthened part of the cover plate of the impeller, so that the weight of the inducer is reduced, more inlet area is provided, and then the efficiency of the pump is improved.

DE 564 826 C (SIEMENS AG) discloses a pump unit for pumping liquid or suspension, the pump unit comprising a centrifugal pump and an inducer in a proximity upstream of an inlet of the centrifugal pump. The inducer comprises an inducer rotor having sleeve shaped rotor body, the rotor body is provided with a number of blades extending inwards from the rotor body, the inducer rotor is separate to the impeller and rotation speed of the inducer rotor is independently controlled in relation to the rotation speed of the impeller, the inducer comprises an electric motor that is connected to the inducer rotor over belt pulley.

US 2016/305447 A 1 (DREISS ANDREAS [DE] ET AL) discloses a centrifugal pump with a rotating impeller and a rotating diffuser. The diffuser can be rotated with a controlled speed to broaden the operational range of the pump. Such control can be done independently of the rotational speed of the impeller to tailor pump operation to a particular NPSH, efficiency, fluid flow or related requirement. In one preferred form, the impeller and diffuser are made to counter-rotate relative to one another, while the independent rotational speed of each can be provided by one or more motors, as well as a variable-speed transmission coupled to such motor or motors.

U.S. Pat. No. 3,981,628 A (CARTER JAMES C) discloses an electric motor driven inducer equipped centrifugal pump unit provided with a possibility to disconnect the inducers from co-rotation with the main impeller shaft while still retaining the main shaft for support and are powered by a source in the unit such as a slip coupling, a hydraulic turbine driven by pumpage from the pump impeller, or a separate electric motor. These power sources drive the inducer at speeds slower than the pump impeller to develop the desired suction head for the impeller without drawing excessive power or producing undesirable thrusts and reduce pump-out time for the last few feet of cargo. A hydraulic or magnetic clutch coupling with the main electric motor drive can be used in combination with the turbine power source for the inducer to start the pumping action.

U.S. Pat. No. 3,004,494 A (CORBETT MARSHALL J) discloses a pumping unit comprising in combination a rotary power-driven pump centrifugal impeller unit, a housing surrounding the impeller unit and a rotary inducer impeller mounted in close proximity to the impeller unit. The inducer is driven by fluid, and more specifically is driven by fluid by-passed from the pump output.

SUMMARY

In this disclosure there will be used the following determinations of ex-pressing a Net Positive Suction Head (NPSH) relative to a centrifugal pumping system. It equals to total pressure that is expressed as height of liquid column of pumped medium (Head in meters):

- NPSHa: The Net Positive Suction Head Available at the pump impeller inlet. NPSHa is a value that expresses the total pressure of a liquid as it enters the pump. It is a measure of the pressure that stands between the liquid in its current state and the formation of vapor bubbles (boiling).
- NPSHr: The Net Positive Suction Head Required by the pump to operate without experiencing damaging cavitation and a dramatic reduction in pumping production. NPSHr is a value that expresses the minimum total head that must be acting on a liquid as it enters the pump impeller to avoid excessive cavitation and degradation of pump performance.

An object of the disclosure is to provide an inducer/centrifugal pump combination in which the performance is considerably improved compared to the prior art solutions. One object is to improve the versatility of the inducer/centrifugal pump combination so that it would be suitable for pumping in various operating conditions, for example, due to variations in inlet pressure due to varying surface level in a tank or due to changes in prevailing consistency of the fluid to be pumped. As the inducer/centrifugal pump combination is intended for constant use of 24/7 in a process industry for years, the pumping efficiency is among top priorities with the inducer/centrifugal pump combination.

Objects of the disclosure can be met substantially as is disclosed in the independent claims and in the other claims describing more details of different embodiments of the disclosure.

According to an embodiment of the disclosure it is provided a pump unit for pumping liquid or suspension, the pump unit comprises a centrifugal pump and an inducer in a proximity upstream of an inlet of the centrifugal pump:

- the centrifugal pump comprises a pump housing forming a flow channel inside the pump housing and an impeller configured to be rotated in the flow channel around a central axis by a shaft,
- the inducer comprises an inducer rotor having sleeve-shaped rotor body, the inducer rotor is configured to be rotated around the central axis in the flow channel, the rotor body is provided with a number of blades extending inwards from the rotor body,
- the inducer rotor is separate to the impeller and rotation speed of the inducer rotor is independently controllable in relation to the rotation speed of the impeller, the inducer comprises an electric motor that is an annular motor that encircles and is connected to the inducer rotor.

This provides an effect by which performance of the pump unit can be considerably improved. In challenging pumping conditions, already a conventional inducer can make the difference between a working/non-working pumping while the present disclosure enables to achieve the best result in terms of NPSH in demanding pumping conditions, net efficiency and operational flexibility. The independently controllable inducer can be utilized to create just the needed extra NPSH to aid the centrifugal pump and avoid cavitation or to fluidize the suspension or to separate gas from the pumped medium. The inducer rotor rotation speed is variably and/or independently controllable in relation to the rotation speed of the impeller. There are several possible ways to control the rotational speed of the inducer and the impeller. This enables a variety of different drive modes for the pump unit, from staring the pumping to a situation where the pumping is in a steady state mode, and for varying surface level on the pump unit suction side. These drive modes can comprise for example that the inducer is started first, then the impeller; or the inducer is driven in a higher or lower rpm than the impeller. Or the acceleration curves for these are different, in order to achieve a wanted flow to the pipeline.

The annular motor that encircles the inducer rotor is especially to enable a compact design of the inducer. It also enables the pump unit to be handled con-struction wise as a single unit.

According to an embodiment the inducer rotor and impeller are drivable by separate electric motors electrically connected to a common control unit. Depending to an actual pumping control system, the controls of the present pump unit are advantageously combined so that the inducer and the centrifugal pump can be operated in a coordinated way. As the mass flow or volumetric flow rate through both the inducer and centrifugal pump will be the same, each can be driven as to optimize the energy consumption of the pumping.

According to an embodiment of the disclosure the inducer rotor is rotatable to the opposite or to the same direction as the impeller. This direction depends on the liquid or suspension to be pumped and design parameters of the centrifugal pump.

According to an embodiment of the disclosure the inducer comprises an inlet, an inducer housing for enclosing the stator, annular motor and rotor, the inducer housing being connected to the pump housing via a flange attachment at a distance from 0.01 up to 10 times the diameter of the flow channel. The effect of this feature is to achieve a compact pump unit where the inducer rotor and impeller are at a sufficiently close distance to each other. The inducer creates a flow field in the flow channel and if the distance between the inducer rotor and impeller is relatively long, the flow field has equalized before the impeller and then the situation would be the same as just having two pumps in series, not having the desired effect as the inducer normally does.

According to an embodiment of the disclosure a sensor for detecting cavitation is provided in the flow channel between the inducer rotor and impeller. As the cavitation is one of the main constraints in pumping, it is of high interest to know when such phenomenon is about to occur or is already on. With the present pump unit, the cavitation at the inlet side of the impeller is the most decisive, because the impeller is the one determining the NPSH required (NPSHr) by the pump unit. An alternative or complementary way is to measure temperature, pressure—both static and calculated dynamic pressure and volumetric flow rate on the same location and calculate required NPSH increase by the inducer to prevent cavitation.

According to an embodiment of the disclosure a method is provided for controlling a pump unit for pumping liquid or suspension, the pump unit comprising a centrifugal pump and an inducer in a proximity upstream of an inlet of the centrifugal pump:

- the centrifugal pump comprises a pump housing forming a flow channel inside the pump housing and an impeller configured to be rotated in the flow channel around a central axis by a shaft,
- the inducer comprises an inducer rotor having sleeve-shaped rotor body, the inducer rotor configured to be rotated around the central axis in the flow channel, the rotor body is provided with a number of blades extending inwards from the rotor body,
- the inducer rotor is separate to the impeller and rotation speed of the inducer rotor is independently controlled in relation to the rotation speed of the impeller, the inducer comprises an electric motor that is an annular motor that encircles and is connected to the inducer rotor,
- in the method controlling of the pump unit is determined as a combination of the inducer and centrifugal pump at least on parameters of total volumetric flow rate and pressure difference over the pump unit. The total volumetric flow rate refers here material flow through the flow channel. The controlling of the pump unit is made by adjusting both the inducer and centrifugal pump in a balanced way so that the output as NPSH is as wanted and there is a clear margin to the outbreak of cavitation.

According to an embodiment of the disclosure the pump unit is controlled so that an output power of the inducer being less than an output power of the centrifugal pump. Thus, the basic idea of the feature is that the inducer is utilized in preparing a flow to be subject to an impact of more powerful impeller/centrifugal pump.

According to embodiments of the present disclosure, the inducer rotor rotation speed is controlled based on detected cavitation at the centrifugal pump, the head generated by the inducer is increased or decreased to maintain a margin to an outbreak of cavitation of the impeller. As in the basic configuration of the pump unit, especially on the inducer, there are no other adjusting parameters than rotation speed of the inducer rotor. This means that the rotation speed is the determining parameter in controlling the inducer. Depending on the load, the same rotation speed requires different torque or power from the electric motor of the inducer. This actual control of the electric motor is done by the control unit, being an in-verter or like.

In this description the term Net Positive Suction Head Available NPSHa at the pump inlet means pump unit in general. The NPSHa is a value that expresses the total head of a liquid as it enters the pump unit. It is a measure of the pressure that stands between the liquid in its current state and the formation of vapor bubbles (boiling) and it is expressed as height of liquid column of pumped medium. However, with the present disclosure the flow conditions change as a parameter of position along the flow channel and in relation to the inducer and impeller, so if necessary, the NPSHa is here divided to be determined at two positions, a NPSHaA at the inlet of the inducer being the same as the inlet of the pump unit and a NPSHaB at the inlet of the impeller, thus in the flow channel between the inducer and impeller.

According to an embodiment of the present method, the pump unit is controlled based on a surface level on pump suction side wherein a NPSHaA at an inlet before (meaning upstream) the pump unit is measured, calculated or otherwise determined, and if necessary, the output power of the inducer is increased or decreased to affect a NPSHaB at the flow channel before (upstream) the impeller, so that during operation of the pump unit the NPSHaB is greater than a NPSHr of the centrifugal pump. Thus the inducer is driven so that the centrifugal pump has a margin to the outbreak of the cavitation at the impeller.

Still, according to an embodiment of the present method, the NPSHaB is measured, calculated or otherwise determined, and the inducer rotor rotation speed/output power is driven along a predetermined NPSHr-curve for a given operation condition.

Still, according to an embodiment of the present method, the pump unit is controlled based on a rheology of the fluid to be pumped so that necessary fluidization parameters of the fluid are predetermined to enable operation of the pump unit, and the inducer rotor rotation speed/output power is controlled to a desired volumetric flow rate. This is especially suitable for fluids of medium consistency pulp, having solids content in a range of 8 to 18%, or 10% 18%. An energy dissipation of the inducer is proportional to both the fluid viscosity and shear rate, it can be assumed that fluidization occurs when a local shear stress equal to the yield stress of the fluid to be pumped, such as pulp suspension. Thus, the fluidization involves rupture of the fibrous network on a local scale. For viscous fluids, inducer can be characterized by a power number—Reynolds number relationship following equation $Re=D^2N\rho/\mu$, where Re is Reynolds number, D is the diameter of the inducer rotor, N is rotation speed, p is density and p is apparent viscosity of the fluid. Power number $N_p$ indicates nominal power delivered to fluid in certain inducer geometry $N_p=P/(D^5N^3\rho)$. According to an embodiment, this calculated Power number—Reynolds number—curve is used as a reference curve for controlling the inducer rotor rotation speed/output power to operate the pump unit at a desired operational window.

The exemplary embodiments of the disclosure presented in this patent application are not to be interpreted to pose limitations to the applicability of the appended claims. The verb "to comprise" is used in this patent application as an open limitation that does not exclude the existence of also unrecited features. The features recited in dependent claims are mutually freely combinable unless otherwise explicitly stated. The novel features which are considered as characteristic of the disclosure are set forth in particular in the appended claims.

BRIEF DESCRIPTION OF DRAWINGS

In the following, the disclosure will be described with reference to the accompanying exemplary, schematic drawings, in which.

DETAILED DESCRIPTION

Figure 1A:
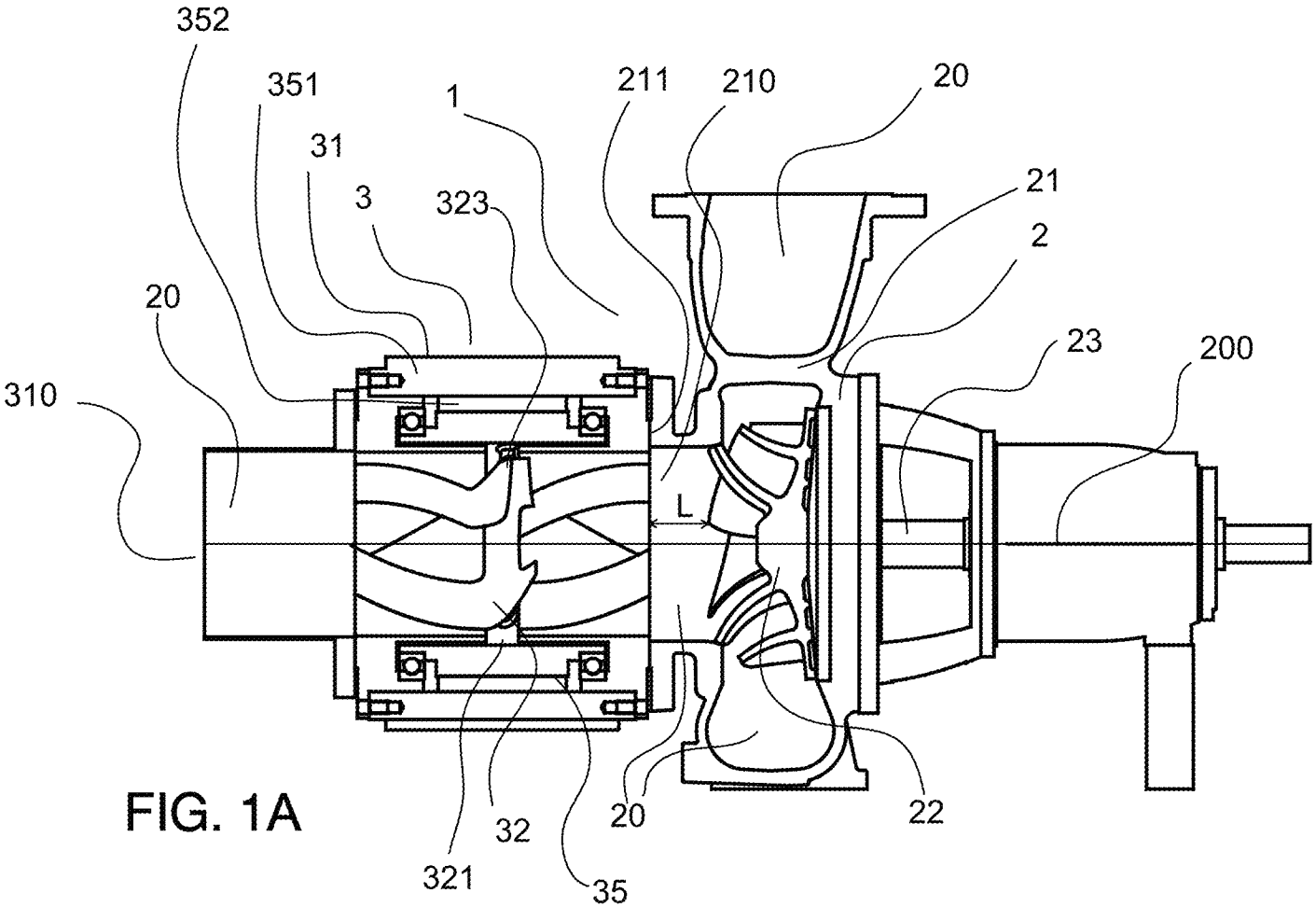
FIG. 1A illustrates a pump unit according to an embodiment of the disclosure.

FIG. 1A depicts schematically a pump unit 1 for pumping liquid or suspension, the pump unit 1 comprises a centrifugal pump 2 and an inducer 3 in a proximity upstream of an inlet 210 of the centrifugal pump 2:

- the centrifugal pump 2 comprises a pump housing 21 forming a flow channel 20 inside the pump housing 21 and an impeller 22 configured to be rotated in the flow channel 20 around a central axis 200 by a shaft 23,
- the inducer 3 comprises an inducer rotor 32 having sleeve-shaped rotor body 321, the inducer rotor 32 is configured to be rotated around the central axis 200 in the flow channel 20, the rotor body 321 is provided with a number of blades 323 extending inwards from the rotor body 321,
- the inducer rotor 32 is separate to the impeller 22 and rotation speed of the inducer rotor 32 is independently controllable in relation to the rotation speed of the impeller 22, the inducer 3 comprises an electric motor 35 that is an annular motor that encircles and is connected to the inducer rotor 32. As regarding to the present method, the inducer rotor 32 is separate to the impeller 22 and rotation speed of the inducer rotor 32 is independently controlled in relation to the rotation speed of the impeller 22, the inducer 3 comprises an electric motor 35 that is an annular motor that encircles and is connected to the inducer rotor 32,
- controlling of the pump unit 1 is determined as a combination of the inducer 3 and centrifugal pump 2 at least on parameters of total volumetric flow rate and pressure difference over the pump unit 1.

According to the embodiment shown in FIG. 1A the inducer 3 comprises an inlet 310, an inducer housing 31 for enclosing a stator 351, annular motor 352 and rotor 32, the inducer housing 31 being connected to the pump housing 21 via a flange 211 attachment at a distance from 0.01 up to 10 times the diameter of the flow channel 20. This distance can be for example the distance L between the inducer blades 323 and the impeller 22, while the diameter of the flow channel 20 is measured at the inducer 3. This enables to achieve a compact pump unit where the inducer rotor and impeller are at a sufficiently close distance to each other and easy to assembly. The inducer creates a flow field that begins at an inducer/pump unit inlet 310 and continues to the flow channel and if the distance between the inducer rotor and impeller is relatively long, the flow field has equalized before the impeller and then the situation would be the same as just having two pumps in series, not having the desired effect as the inducer normally does.

Figure 1B:
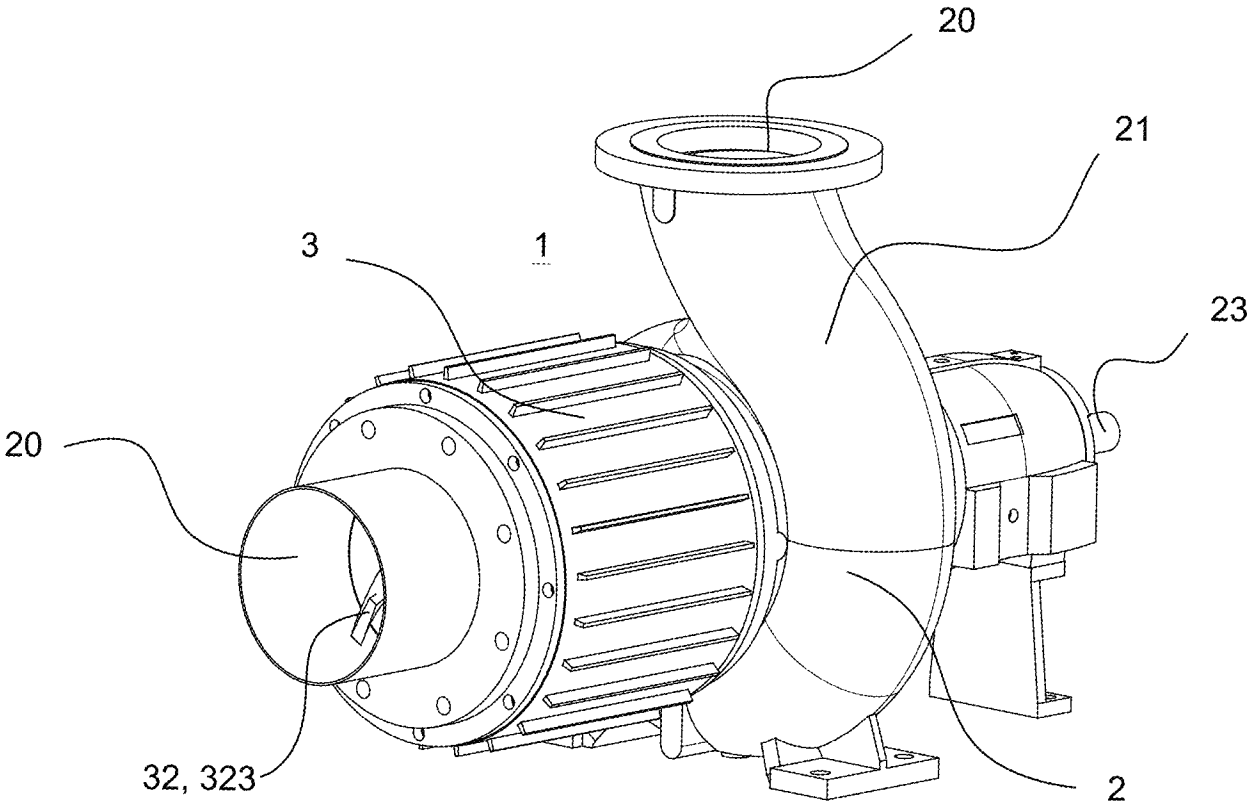
FIG. 1B illustrates a 3D overview of the pump unit of FIG. 1A.

In FIG. 1B it is presented a general outside 3D-overview of the present pump unit 1. The FIG. 1B illustrates an embodiment of centrifugal pump 2, comprising a pump housing 21 forming a flow channel 20 inside the pump housing 21 and an inducer 3 comprising an inducer rotor 32 configured to be rotated in the flow channel 20 by a shaft 23, the rotor 32 is provided with blades 323.

Figure 2:
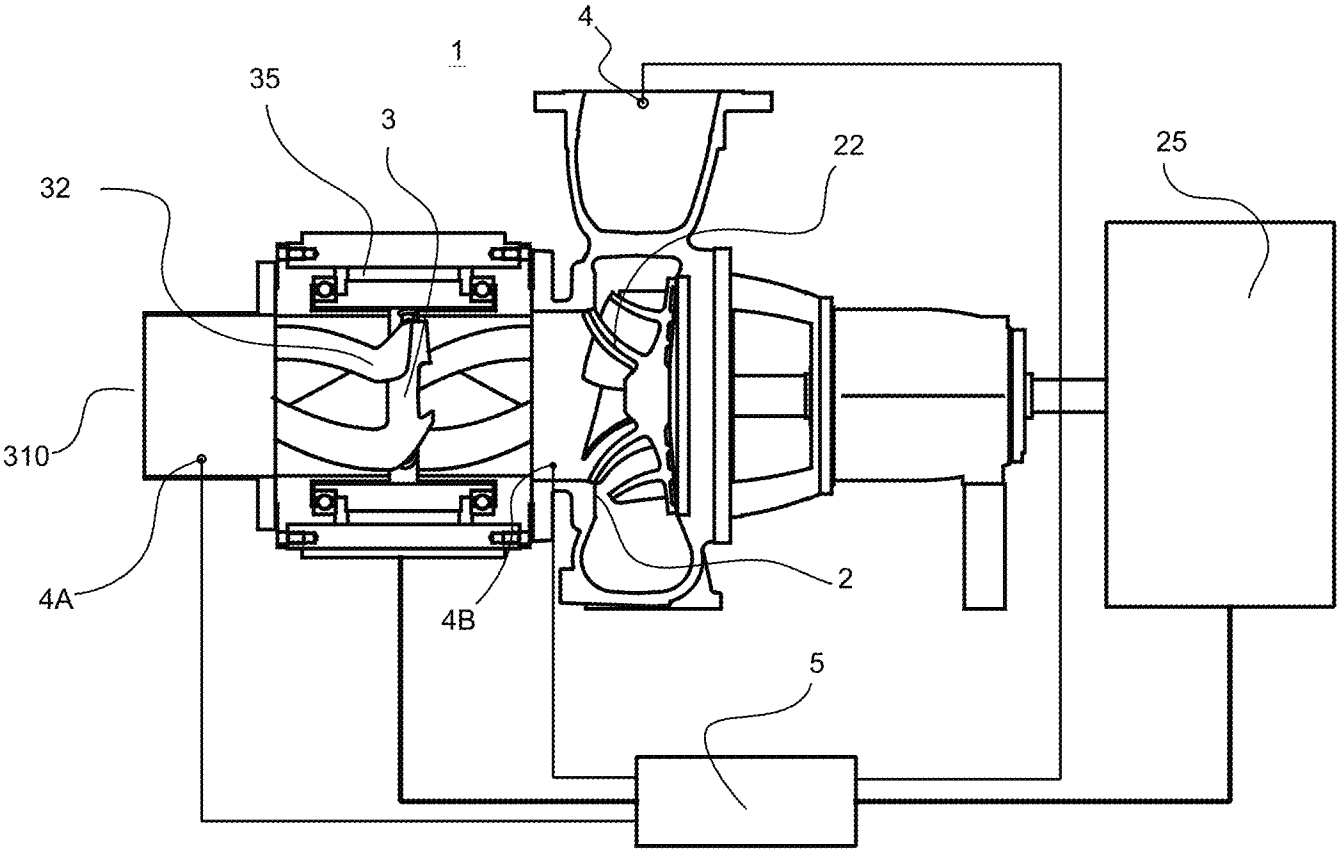
FIG. 2 illustrates a pump unit according to another embodiment of the disclosure connected to a control system.

According to an embodiment shown in FIG. 2, the inducer rotor 32 and impeller 22 are drivable by separate electric motors 25, 35 electrically connected to a common control unit 5. Preferably the pump unit 1 is controlled so that an output power of the inducer 3 is less than an output power of the centrifugal pump 2. There are several operational principles that can be applied in the control of the pump unit. For example, the inducer rotor 32 rotation speed can is controlled based on detected cavitation at the centrifugal pump 2, the head generated by the inducer 3 is increased or decreased to maintain a margin to an outbreak of cavitation of the impeller 22. In FIG. 2 it is also illustrated some possible sensors 4, 4A, 4B to monitor the centrifugal pump or to determine NPSHaA or NPSHaB values: pressure sensor, acoustic sensor for cavitation monitoring, vibration monitoring sensor, on-line consistency sensor, on-line gas content meter, thermometer. The pump unit 1 can comprise means to monitor the centrifugal pump: calculations using software of variable speed drive. A control unit 5 can comprise executable instructions to control the inducer rotor 32 rotation speed/output power based on sensor signal.

Also, in FIG. 2 it is illustrated how the pump unit 1 is controlled based on a surface level on pump unit 1 suction side wherein a NPSHaA at an inlet 310 before the inducer/pump unit 1 is measured by a sensor 4A, calculated or otherwise determined, and if necessary, the output power of the inducer 3 is increased or decreased to affect a NPSHaB, measured at sensor 4B at the flow channel 20 before the impeller 22, so that during operation of the pump unit 1 the NPSHaB is greater than a NPSHr of the centrifugal pump 2.

Figure 3B:
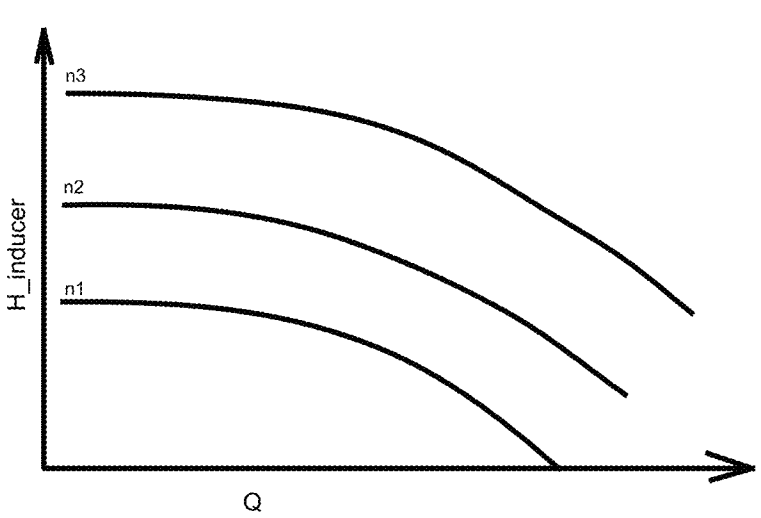
FIGS. 3A and 3B illustrates different curves of the effect of the inducer.
Figure 3A:
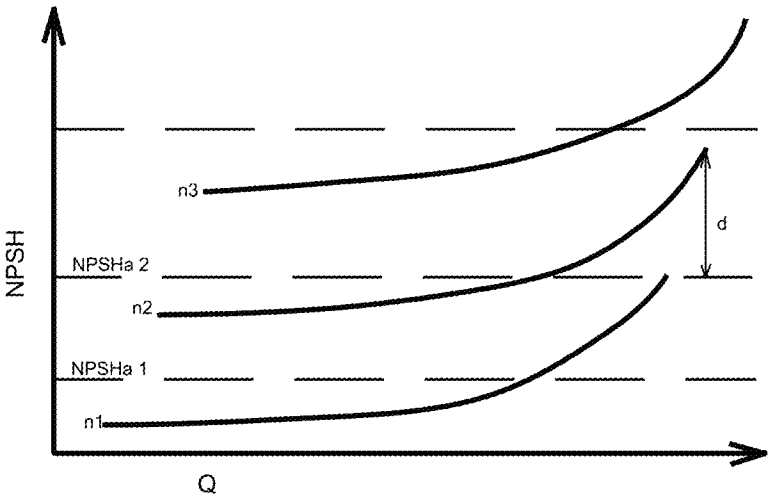

In the following the method of the present disclosure is explained in more detail with reference to accompanying graphs in FIGS. 3A, 3B, 3C and 3D illustrates pumping curves in different situations. FIG. 3A presents NPSH (y-axis) in a function of volumetric flow rate Q (x-axis) for a centrifugal pump. There are three horizontal levels (dashed lines, NPSHa 1, NPSHa 2, etc.) describing different surface level generated suction heads and the three curves illustrates the required NPSHr of the centrifugal pump at different rotational speeds n1, n2 and n3 of the impeller, depending on the volumetric flow rate Q. This means that on higher Q the required NPSHr of the centrifugal pump can be more than the available NPSHa 1, 2 etc. This would mean that the centrifugal pump would begin to cavi-tate. At FIG. 3B it is shown the effect of the inducer by dependency of head (or NPSH) and volumetric flow rate Q with different rotational speeds n1, n2, n3 of the inducer rotor. As can be seen on FIG. 3B, the head H decreases as the volumetric flow rate Q has increased. However, as one can note in FIG. 3A, with higher Q the NPSH difference between the required NPSHr of centrifugal pump and available NPSHa 2 increases as is illustrated with arrow d—an inducer rotated at n1, n2 or n3 can generate the missing d of NPSH even at higher Q as shown in FIG. 3B. Thus, it would make it possible to achieve such high Q with the pump unit without cavitation. This means that by increasing the rotational speed of the inducer rotor, it can compensate a significant amount of NPSH that would otherwise be needed to be arranged at a plant for example by increasing surface level in a suction vessel. The present disclosure having independently controllable inducer and centrifugal pump it enables optimal and effective performance of the pump unit on wide range of operational conditions.

Figure 3D:
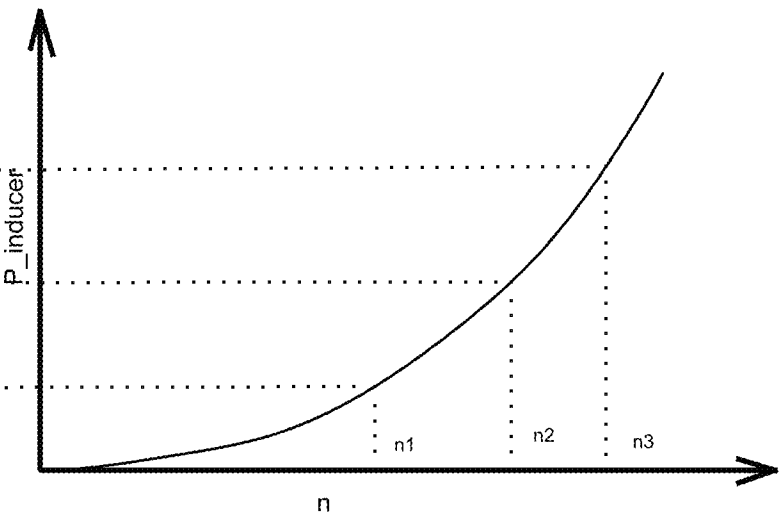
FIGS. 3C and 3D illustrates still different curves about the effect of inducer.
Figure 3C:
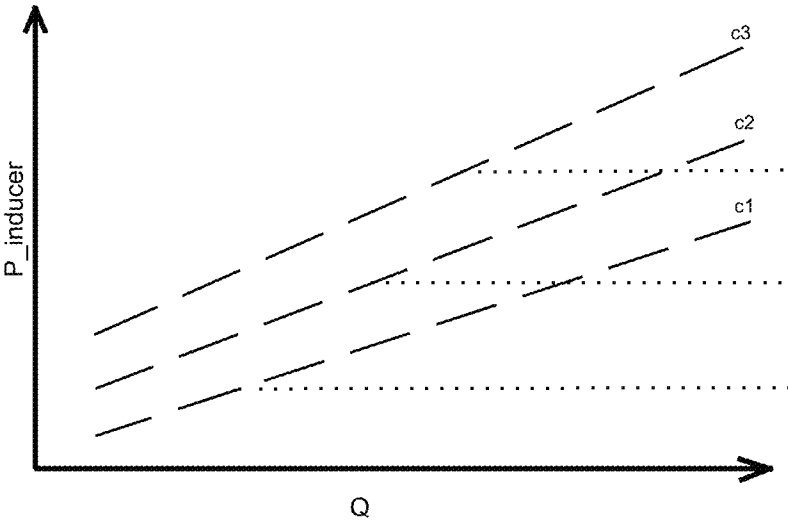

FIGS. 3C and 3D illustrates how the inducer rotor 32 rotation speed/output power is controlled based on required gas separation or fluidization for given fluid to be pumped, the required gas separation can be determined based on gas detection, predetermination or other means to determine the gas content in the fluid. The curves c1, c2 and c3 presents different materials to be pumped, the difference can be in consistency or in respect to gas content. The power needed by the inducer depends on the needed fluidization or gas removal in order to create a required volumetric flow rate Q.

For practical example in one studied pump unit 1, if the inducer rotor is driven in a speed 1100-1780 rpm for Q=200 l/s, it would fluidize the material enough and reduce the flow resistance so that the centrifugal pump can be driven at 1780 rpm to create the requested head.

Figure 4:
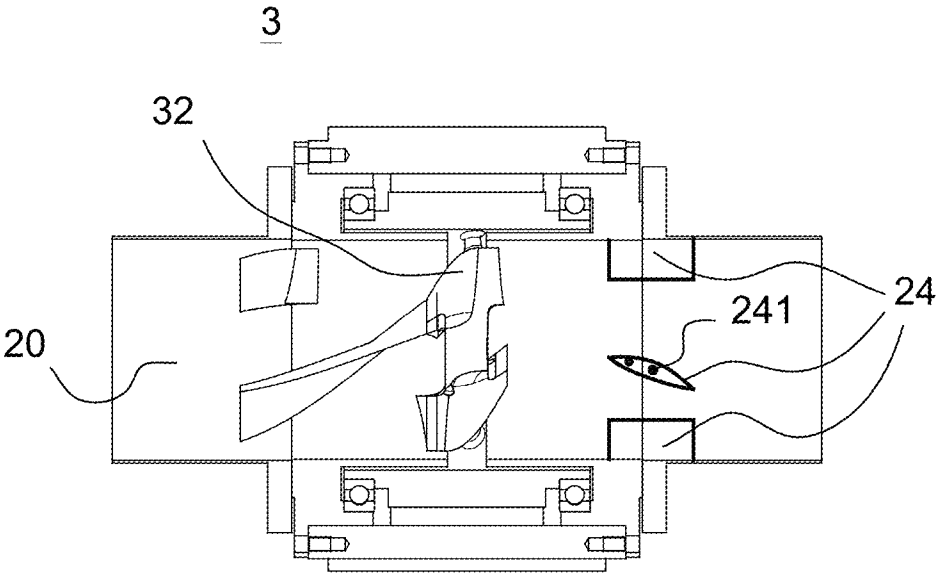
FIG. 4 illustrates an embodiment of the pump unit having guide vanes between the inducer and the centrifugal pump.

In FIG. 4 it is illustrated an embodiment where between the inducer 3, or the inducer rotor 32 and the impeller 22 (not shown in FIG. 4) it is provided guide vanes 24 having fixed or adjustable pitch. These guide vanes can be of conventional type just for controlling the swirl in the flow channel 20 or these can be such that the guide vanes 24 comprise conduits 241 for gas removal from the liquid.

Figure 5:
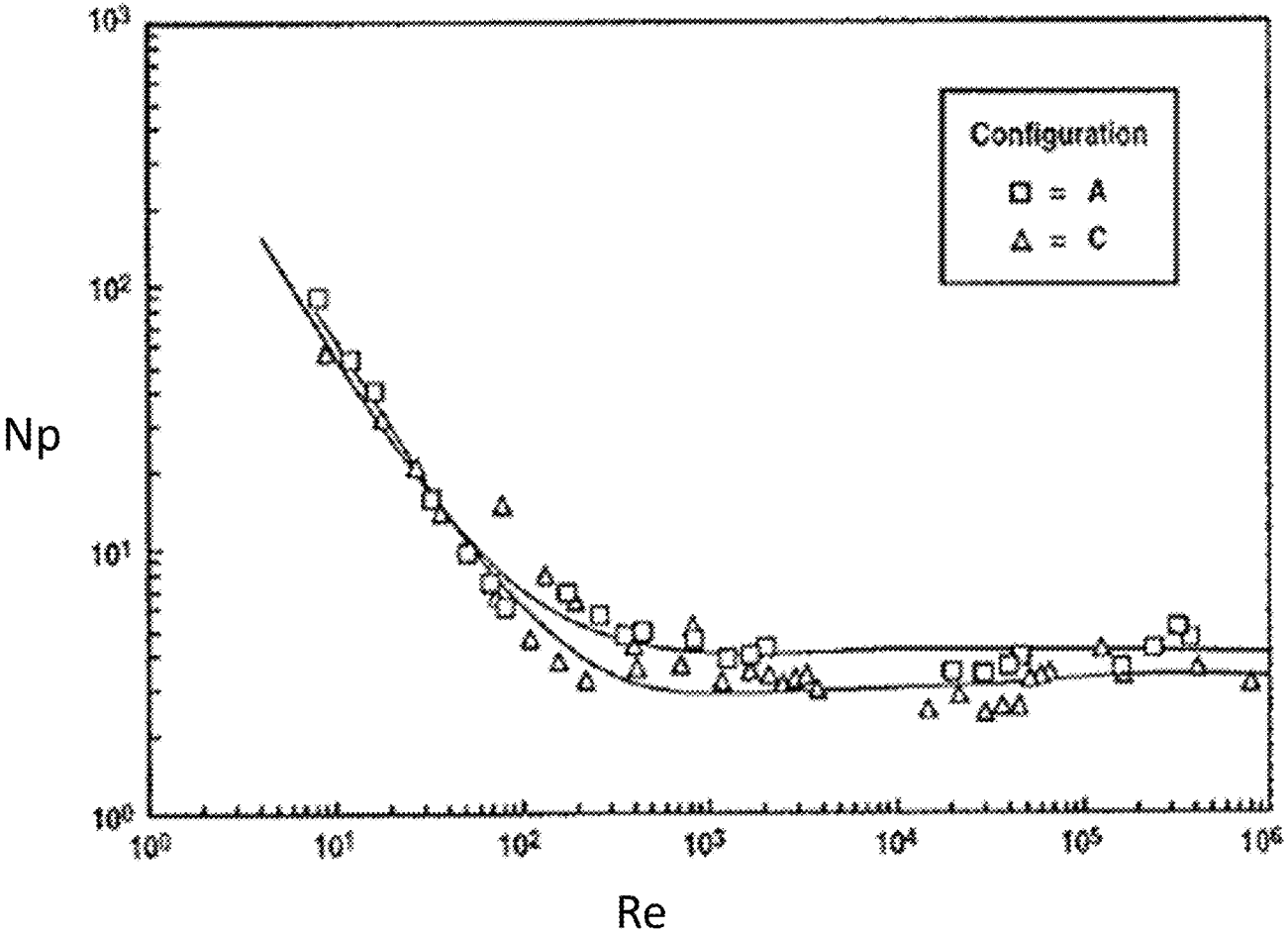
FIG. 5 illustrates an embodiment of a power number/Reynolds number curve.

In FIG. 5 it is illustrated an embodiment of the present method, the pump unit 1 is controlled based on a rheology of the fluid to be pumped so that necessary fluidization parameters of the fluid are predetermined to enable operation of the pump unit, and the inducer rotor rotation speed/output power is controlled to a desired volumetric flow rate. An energy dissipation of the inducer is proportional to both the fluid viscosity and shear rate. It can be assumed that fluidization occurs when a local shear stress equal to the yield stress of the fluid to be pumped, such as pulp suspension. Thus, the fluidization involves rupture of the fibrous network on a local scale. For viscous fluids, inducer can be characterized by a power number—Reynolds number relationship following equation $Re=D^2N\rho/\mu$, where Re is Reynolds number, D is the diameter of the inducer rotor, N is rotation speed, p is density and p is apparent viscosity of the fluid. Power number $N_p$ indicates nominal power delivered to fluid in certain inducer geometry $N_p=P/(D^5N^3\rho)$. In FIG. 5 it is presented such Power number/Reynolds number curve for two different configurations, illustrated as configurations A and C. According to an embodiment, this calculated Power number—Reynolds number—curve is used as a reference curve for controlling the inducer rotor rotation speed/output power to operate the pump unit at a desired operational window.

Figure 6:
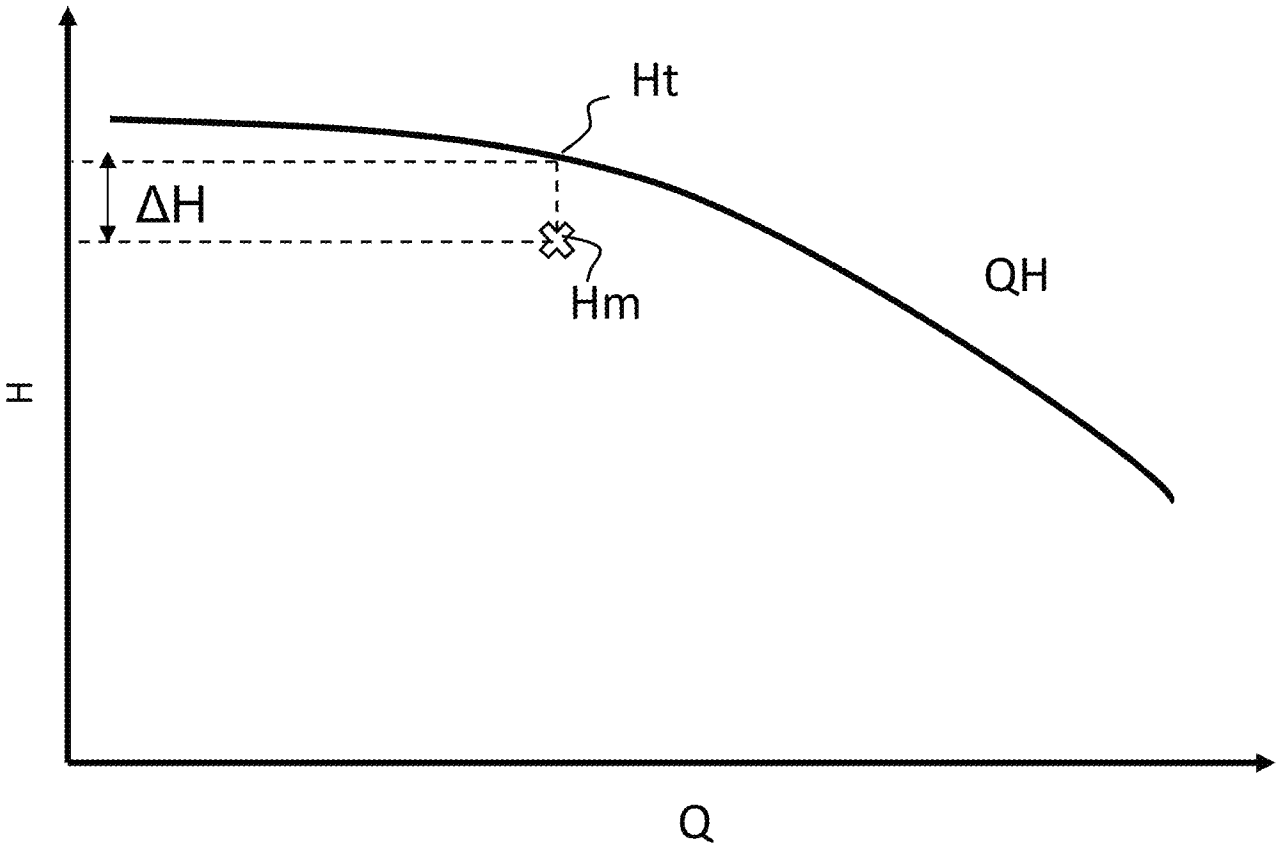
FIG. 6 illustrates an embodiment of a target QH-curve.

In FIG. 6 it is illustrated a target QH-curve, volumetric flow rate Q on the horizontal axis and head on the vertical axis. If a measured head Hm at a given Q is below the curve point head target Ht then the difference between the Ht and Hm is ΔH, the inducer speed is increased to meet the target/reference curve. As the necessary fluidization parameters of the fluid are predetermined to enable operation of the pump unit 1, and the inducer rotor 32 rotation speed/output power is controlled to a desired volumetric flow rate as illustrated in FIG. 6.

While the disclosure has been described herein by way of examples in connection with what are, at present, considered to be the most preferred embodiments, it is to be understood that the disclosure is not limited to the disclosed embodiments, but is intended to cover various combinations or modifications of its features, and several other applications included within the scope of the disclosure, as defined in the appended claims. The details mentioned in connection with any embodiment above can be used in connection with another embodiment when such combination is technically feasible.

The invention claimed is:

1. A method for controlling a pump unit for pumping liquid or suspension, the pump unit comprising a centrifugal pump and an inducer in a proximity upstream of an inlet of the centrifugal pump, the centrifugal pump comprising a pump housing forming a flow channel inside the pump housing and an impeller configured to be rotated in the flow channel around a central axis by a shaft, the inducer comprising an inducer rotor having a sleeve-shaped rotor body, the inducer rotor is configured to be rotated around the central axis in the flow channel, the rotor body including a number of blades extending inwards from the rotor body, the inducer rotor being separate to the impeller and a rotation speed of the inducer rotor is independently controlled in relation to a rotation speed of the impeller, the inducer comprising an electric motor that is an annular motor encircling and connected to the inducer rotor, the method comprising:

controlling of the pump unit based on a determination of a combination of the inducer and the centrifugal pump at least on parameters of a total volumetric flow rate and pressure difference over the pump unit, and controlling the pump unit based on a rheology of a fluid to be pumped so that necessary fluidization parameters of the fluid are predetermined to enable operation of the pump unit, and the rotation speed of the inducer rotor or an output power of the inducer rotor is controlled to a desired volumetric flow rate.

2. The method according to claim 1, wherein the pump unit is controlled based on the rheology of the fluid to be pumped so that a calculated Power number-Reynolds number-curve is used as a reference curve to control the rotation speed of the inducer rotor or an output power to operate the pump unit at a desired operational window.

3. The method according to claim 1, wherein the pump unit is controlled so that the output power of the inducer rotor is less than an output power of the centrifugal pump.

4. The method according to claim 1, wherein, wherein the rotation speed of the inducer rotor is controlled based on detected cavitation at the centrifugal pump, and a head generated by the inducer is increased or decreased to maintain a margin to an outbreak of cavitation of the impeller.

5. The method according to claim 1, wherein an NPSHaB (Net Positive Suction Head Available at the inlet of the impeller) is measured, calculated or otherwise determined, and the rotation speed of the inducer rotor or a head of the inducer is driven along a predetermined NPSHr (NPSH required)-curve for a given operation condition.

6. The method according to claim 1, wherein the rotation speed of the inducer rotor or the output power of the inducer rotor is controlled based on required gas separation for a fluid to be pumped, the required gas separation determinable based on gas detection or predetermination to determine a gas content in the fluid.

7. The pump unit connected to a controller configured to execute the method of claim 1, wherein such that the pump unit is controlled based on the rheology of the fluid to be pumped so that necessary fluidization parameters of the fluid are predetermined to enable operation of the pump unit and the rotation speed of the inducer rotor or the output power of the inducer rotor is controlled to the desired volumetric flow rate, the pump unit comprises:

the centrifugal pump comprising the inducer in the proximity upstream of the inlet of the centrifugal pump:

the centrifugal pump comprising the pump housing forming the flow channel inside the pump housing and the impeller configured to be rotated in the flow channel around the central axis by the shaft, the inducer comprising the inducer rotor having the sleeve-shaped rotor body, the inducer rotor is configured to be rotated around the central axis in the flow channel, the rotor body includes the number of blades extending inwards from the rotor body, the inducer rotor is separate to the impeller and the rotation speed of the inducer rotor is independently controllable in relation to the rotation speed of the impeller, the inducer comprising the electric motor that is the annular motor encircling and being connected to the inducer rotor.

8. The pump unit according to claim 7, wherein the inducer rotor and the impeller are drivable by separate electric motors electrically connected to the controller.

9. The pump unit according to claim 7, wherein the inducer rotor is rotatable to an opposite or to the same direction as the impeller.

10. The pump unit according to claim 7, wherein the inducer comprises an inlet, an inducer housing to enclose a stator, the annular motor and the inducer rotor, the inducer housing being connected to the pump housing via a flange attachment at a distance from 0.01 up to 10 times a diameter of the flow channel.

11. The pump unit according to claim 7, wherein guide vanes are disposed between the inducer and the impeller, the guide vanes having a fixed or adjustable pitch.

12. The pump unit according to claim 11, wherein the guide vanes comprise conduits for gas removal from the liquid.

13. The pump unit according to claim 7, wherein the rotation speed of the inducer rotor is variably or independently controllable in relation to the rotation speed of the impeller.

14. The pump unit of claim 7, further comprising at least one sensor of the following sensors to monitor the centrifugal pump or to determine the NPSHaA (Net Positive Suction Head Available at the inlet of the inducer) or NPSHaB values: a pressure sensor, an acoustic sensor for cavitation monitoring, a vibration monitoring sensor, an on-line consistency sensor, an on-line gas content meter, or a thermometer.

15. The pump unit of claim 7, further comprising a device configured to monitor the centrifugal pump calculations using software of variable speed drive.

16. The controller for controlling the pump unit according to claim 14, the controller comprising executable instructions to control the rotation speed of the inducer rotor or the output power of the inducer rotor based on a sensor signal of the at least one sensor such that the pump unit is controlled based on the rheology of the fluid to be pumped so that the necessary fluidization parameters of the fluid are predetermined to enable operation of the pump unit, and the rotation speed of the inducer rotor or the output power of the inducer rotor is controlled to the desired volumetric flow rate.

* * * * *